United States Patent [19]

Suffern

[11] 4,191,290

[45] Mar. 4, 1980

[54] TWO-WAY CONTAINER PACKAGE

[75] Inventor: Bruce C. Suffern, Streamwood, Ill.

[73] Assignee: Illinois Tool Works Inc., Chicago, Ill.

[21] Appl. No.: 31,232

[22] Filed: Apr. 18, 1979

[51] Int. Cl.[2] ..... B65D 75/00

[52] U.S. Cl. ..... 206/150; 206/139; 206/427

[58] Field of Search ..... 206/139, 146, 150, 151, 206/427, 428

[56] References Cited

U.S. PATENT DOCUMENTS

| | | | |
|---|---|---|---|
| 2,735,631 | 2/1956 | Sexton | 242/139 |
| 3,302,783 | 2/1967 | Lyon . | |
| 3,307,692 | 3/1967 | Chidsey, Jr. . | |
| 3,358,828 | 12/1967 | Tolaas | 206/147 |
| 3,404,912 | 10/1968 | Watts | 294/87.2 |
| 3,462,020 | 8/1969 | Hamilton et al. | 206/146 |

*Primary Examiner*—Joseph M. Moy

*Attorney, Agent, or Firm*—Thomas W. Buckman; Robert W. Beart

[57] ABSTRACT

A package for a plurality of containers having retained pull tab openers. The package creates a primary package for distributing and handling such containers as well as a secondary package permitting the users of the containers to return them when empty. The package incorporates a device with a plurality of slots, equal in number to the number of containers originally packaged, and of a size to accept the retained pull tabs on the containers thereby creating a secondary package for repackaging the containers, with the secondary package having generally the same configuration as the primary package. The package of this invention also incorporates a thermoplastic strip with a plurality of bands to resiliently retain the containers in the primary packaging mode. The slot devices may either be incorporated in a discrete paperboard overlay or in arms which are integral with the bands of the carrier device.

6 Claims, 6 Drawing Figures

TWO-WAY CONTAINER PACKAGE

BACKGROUND AND SUMMARY OF THE INVENTION

This invention is concerned generally with a package for a plurality of can-type containers which is adapted to repackage the same containers for return when the contents of the containers have been removed.

More particularly, the invention relates to a two-way packaging device for such containers which incorporate a retained pull-top opener which may be inserted and secured in slots in the packaging device to facilitate the repackaging of these empty containers.

Carrier devices of the type generally shown in U.S. Pat. No. 2,874,835 are a widely accepted manner of packaging can-type containers for consumers generally in a six-pack array. However, recently a need has arisen for some convenient manner of repackaging empty containers to facilitate their efficient handling for return and/or disposal.

It is accordingly a primary object of this invention to provide a package which not only incorporates a primary package, enabling a consumer to purchase and efficiently handle a plurality of cans but also a secondary package which facilitates the repackaging of empty containers.

One of the advantages of the invention is the incorporation of features permitting its adaptability for use with containers having pull tabs or opening means which are retained on the can in the form of a pivotable lever.

Other objects and advantages of the invention will become apparent from the following description and the accompany drawing wherein:

DETAILED DESCRIPTION OF THE PREFERRED EMBODIMENTS

Figure 1:
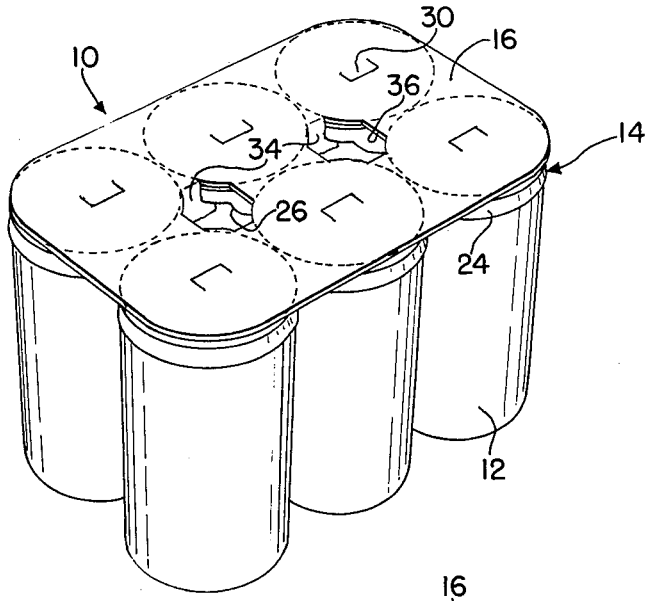
FIG. 1 is an isometric view of the two-way container package in its primary package mode according to one embodiment of the invention.

Generally, this invention can be described as both a primary package and package making device and secondary package and package making device. The primary package permits efficient and convenient handling of a plurality of containers while the secondary package enables consumers to regroup or repackage the empty containers for disposal and/or return to redeem a deposit. Reference to FIG. 1 shows a preferred embodiment of a primary package 10 while reference to FIG. 3 shows a secondary package 11 created by portions of the primary package.

Figure 3:
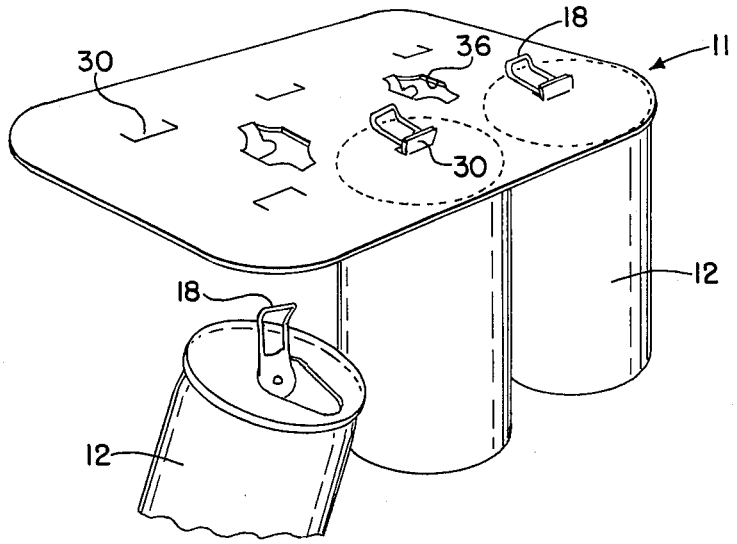
FIG. 3 is an isometric view of the secondary package created by the embodiment of FIG. 1.

Referring now with more particularity to FIGS. 1 and 3, the primary package 10 will be shown to comprise a plurality of containers 12, a thermoplastic strip-type carrier 14 and a sheet of paperboard material 16 overlaying the lids of the containers and the carrier. The paperboard overlay 16 has a perimeter which generally corresponds to the outer margin created by the combined outer peripheries of the lids of the containers in the array. The carrier device 14 is typical of such prior art devices and includes a plurality of container encircling bands 24 and a pair of spaced finger receiving apertures 26 between said bands to permit grasping and comfortable handling of the package. The paperboard overlay 16 is temporarily secured to and forms part of the package 10 by two pairs of tabs 34 positioned over and registering with apertures 26. These tabs include ears which permit their locking beneath the surface of the apertures 26. The finger holes 26 can still be effectively utilized to handle the package 10. In addition to the secondary packaging features of the overlay, which will be described later, it should be apparent that the overlay covers and protects the lids of the containers should such a feature be desirable.

Figure 2:
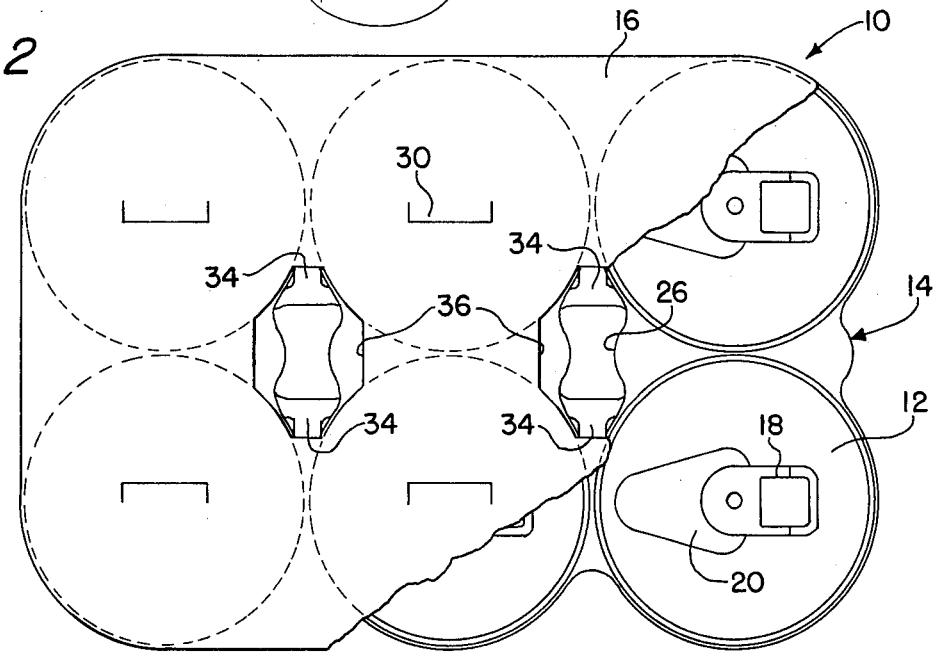
FIG. 2 is a top plan view with a partial cut-away section of the preferred embodiment of the package shown in FIG. 1.

The features of this invention are particularly designed to be utilized in a package of containers which incorporate lids with retained pull tabs. For example, reference to FIGS. 2 and 3 show a lid with a scored panel 20 adapted to be opened by a lever-like tab 18 which is retained on the lid after the opening operation. Such lids and retained tab features are well known and a detailed description of this feature is not considered essential to the understanding of this invention.

Now attention is directed to the plurality of slots or tabs 30 located within the perimeter of the paperboard device 16. It should be noted that slots 30 are equal in number to the number of containers 12 with each slot generally overlaying the center of an associated container 12. When the contents of the containers 12 are emptied, the containers may be selectively secured to the paperboard overlay 16 by merely inserting the retained tabs 18 through the apertures or slots 30 and bending the tabs downwardly against the upper surface of the overlay 16. The slots should be of a size sufficient to receive and retain the tab without fear of accidental removal. FIG. 3 shows the construction of a secondary package 11 with the paperboard device 16. The aperture 36 created by the downward depression of the tabs 34 creates suitable finger holes for carrying the secondary package.

Figure 4:
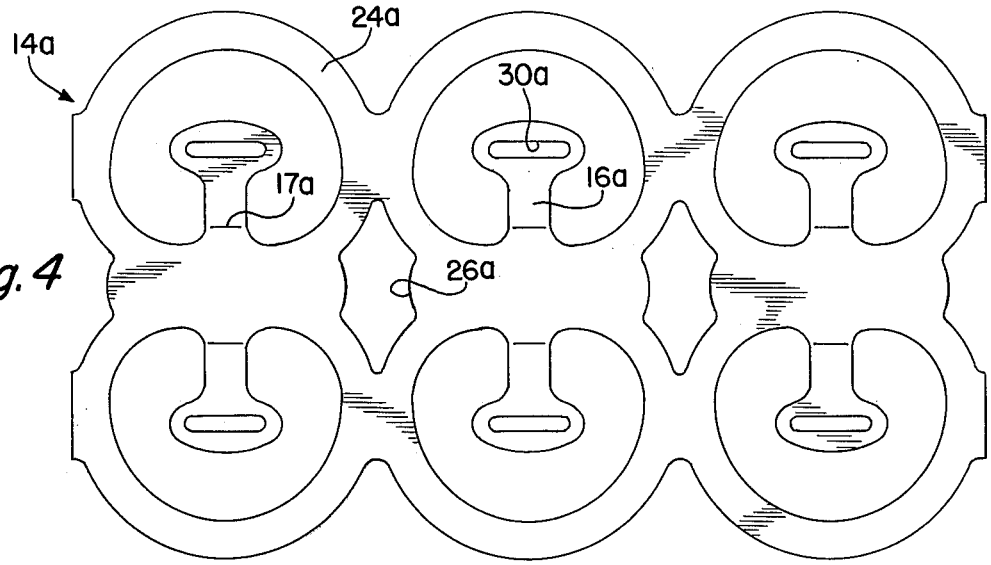
FIG. 4 is a top plan view of a carrier device in accordance with a second embodiment of the invention.
Figure 5:
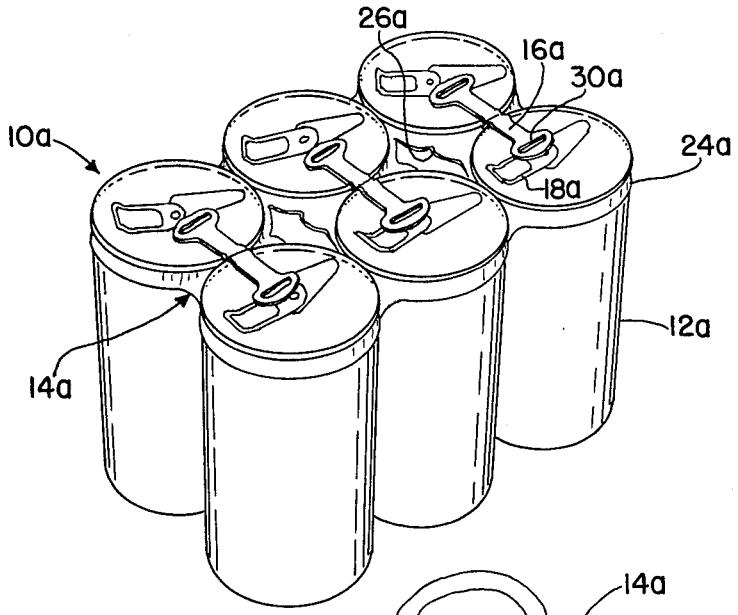
FIG. 5 is an isometric view of a primary package created by the carrier device of FIG. 4.
Figure 6:
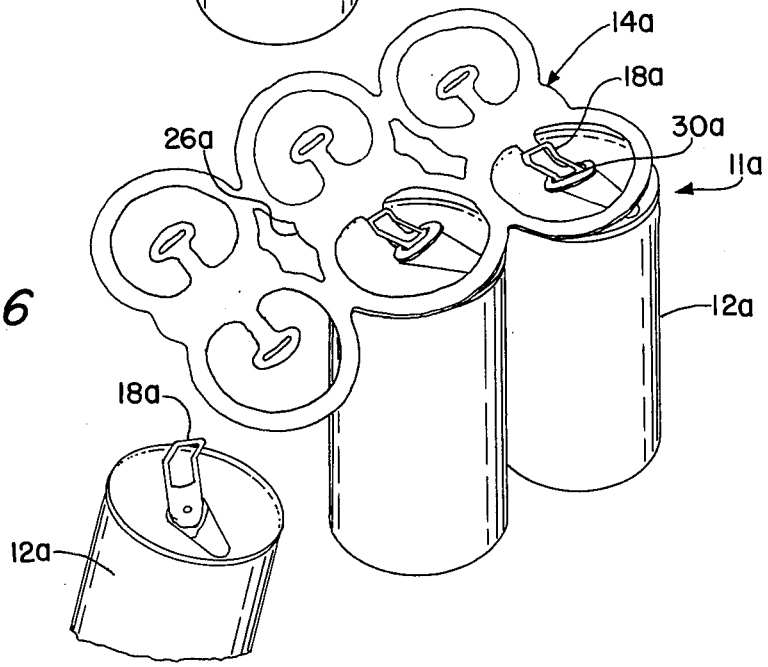
FIG. 6 is an isometric view of the secondary package created by the device of FIG. 5.

Turning to FIGS. 4–6, an alternate embodiment of the invention will be described. In FIG. 4, a carrier strip is shown which is very similar to the strip used to produce the primary package of the above-described embodiment with the addition of integral means to retain empty containers. The carrier device 14*a* thus includes a plurality of bands 24*a* creating apertures into which the containers are inserted and retained as a primary package 10*a*. However, the innermost region of each aperture in the carrier device includes an inwardly extending tab 16*a* with a T-shaped extremity including a slot 30*a*. In keeping with the invention, this slot 30*a* generally overlies the center of an associated container 12*a*. The carrier device 14*a*, and more particularly slots 30*a*, are thus adapted to receive the retained tabs 18*a* on the containers creating the secondary package 11*a* shown in FIG. 6. The primary package as shown in FIG. 5 is similar to packages known in the prior art except for the tabs 16*a* extending over the lids. To facilitate the tabs remaining flush against the lids, a bend line 17*a* may be provided in the tabs adjacent the juncture of tab 16*a* with the inner periphery of the aperture in the carrier device. Primary package 10*a* will include finger holes 26*a* and these holes will also serve as a convenient way to handle the secondary package 11*a*. Of course, it is understood that the bands 14*a* need not encircle the containers in the secondary package and could possibly be used as a secondary carrying means for package 11*a*.

I claim:

1. A package for containers and which can be used to repackage the containers after their contents have been removed, the package including a predetermined plurality of said containers including hinged retained tear tab openers, a package making device including a thermoplastic strip having a plurality of bands, each band surrounding and resiliently engaging and retaining thereby a predetermined, circumferential region of the side wall of each container thereby creating a primary package, the plurality of containers thus forming an array having a predetermined perimetrical outer margin created by the combined outer peripheries of the lids of the containers, a plurality of slot means integral with the package making device adapted to receive the retained tab openers thereby creating a secondary package of empty containers, the slot means being equal in number to the containers included in the primary package, each slot means spaced inwardly from the predetermined perimetrical outer margin and spaced from each other distances which permit the location of the containers relative to the package making device and to each other in the secondary package to be substantially the same as in the primary package.

2. The package of claim 1, wherein the package making device further includes a flat sheet member overlying the lids of the containers and having an outer margin substantially corresponding in configuration and dimension to the outer perimetrical margin of said array of containers, means for securing the sheet member to the thermoplastic strip.

3. The package of claim 2, wherein the sheet member includes said plurality of slot means formed therein.

4. The package of claim 1, wherein the sheet member is paperboard material with said plurality of slot means formed therein.

5. The package of claim 1, wherein said thermoplastic strip includes a plurality of tabs equal in number to the containers being packaged, each tab being integral with a band and adapted to extend inwardly toward the center of the aperture created by each band, said slot means being formed in each inwardly extending tab.

6. In a package for containers having hinged retained tear tab openers, a package making device including a flat sheet member adapted to overlie the lids of a plurality of such containers and having an outer margin substantially corresponding in configuration and dimension to the outer perimetrical margin of an array created by a predetermined plurality of closely adjacent containers, a plurality of slot means equal in number to the number of such containers formed in the flat sheet member, each of said slot means being configured to receive and retain a respective hinged retained tear tab opener on such empty containers, thereby creating a package of a closely spaced array of containers when in the empty condition.

* * * * *